United States Patent [19]

Kobayashi et al.

[11] 3,977,607

[45] Aug. 31, 1976

[54] PROJECTING NOZZLE FOR POWDER COATING

[75] Inventors: Kunio Kobayashi, Kamakura; Eiji Saito, Sagamihara; Satoshi Shiki; Hiroshi Hayashi, both of Tokyo, all of Japan

[73] Assignee: Ransburg Corporation, Indianapolis, Ind.

[22] Filed: Sept. 24, 1975

[21] Appl. No.: 616,449

[30] Foreign Application Priority Data

Oct. 16, 1974 Japan ..... 49-118907

[52] U.S. Cl. ..... 239/145; 239/15; 239/300; 239/403

[51] Int. Cl.[2] ..... B05B 5/04; B05B 1/34

[58] Field of Search ..... 239/15, 145, 292, 297, 239/299, 300, 403, 420, 3

[56] References Cited

UNITED STATES PATENTS 3,448,925 6/1969 Cross ..... 239/15

FOREIGN PATENTS OR APPLICATIONS 45-36115 11/1970 Japan ..... 239/145

39-6354 5/1964 Japan ..... 239/290

*Primary Examiner*—John J. Love

*Assistant Examiner*—Andres Kashnikow

*Attorney, Agent, or Firm*—Merrill N. Johnson

[57] ABSTRACT

The projecting nozzle for powder coating is a device for dispersing finely divided powder paint particles in a pattern controlled by swirling air without accumulating unwanted powder particles. A hollow nozzle is located concentrically to a guide member forming a gap through which the powder is projected. Orifices and, or slits located in the guide member direct compressed air in a swirling motion. A porous plate, forming the front of the guide member allows air to pass therethrough and thereby prevents the accumulation of powder particles.

10 Claims, 7 Drawing Figures

PROJECTING NOZZLE FOR POWDER COATING

BACKGROUND OF THE INVENTION

The present invention relates to an improvement of a projecting nozzle for powder coating, more particularly, it relates to the projecting nozzle for powder coating in which a device being capable of adjusting the shape of projection pattern of the powder paint dispersed from the projecting nozzle is provided.

In conventional so-called projection gun-type powder coating apparatus for electrostatic powder coating or other powder coatings, a projection nozzle is provided in a nose portion of an apparatus, and particles of powder coating entrained in carrying air being fed in an apparatus are to be discharged from a projection nozzle in the form of mist, but in order to attain the best coating on the basis of an object of coating and shape, dimension or the like of articles to be painted, it is necessary to properly adjust a shape of pattern or dimension of projection pattern of paint particles to be discharged from a projection nozzle.

According to conventional manners, the adjustment for projection pattern and dimension have been made by: projection nozzles having various kinds of shapes and dimensions have been prepared and they have been used by replacing them with one another;

in paths of paint particles being discharged from projection nozzle, a paint particle deviation member is placed by which flour of paint particles is to be prevented from changing its flowing direction and various kinds of different types or dimension of deviation members are to be used for replacing them with one another;

relative position between projection nozzle and the deviation member is to be changed; the processes set forth above are to be used in a combined manner.

The processes referred to the above require complicated steps as well as many hours for adjusting the shape of pattern and dimension of the pattern. Further, if paint particle deviation member is to be used, paint particle is to be deposited on its surface and to come off the deposited particles intermittently makes the quality of coating obtained worse.

SUMMARY OF THE INVENTION

Accordingly, a general object of this invention is to provide a novel and useful projecting nozzle for powder coating in which the above described disadvantages are removed.

An object of the present invention is to provide a projecting nozzle for powder coating in which it is not necessary to prepare numbers of projection nozzles having different shape and dimension and neither it is necessary to prepare various kinds of paint deviation members or to use deviation members or to change its position. Compressed air for adjustment including a velocity component perpendicular to the direction of flow of the paint particles is discharged and sprayed from a projection nozzle in the form of conical shell, and by changing the pressure, flow-velocity, amount of flour or the like, an adjustment of a desired injection pattern can possibly be carried out.

According to the present invention, a projecting nozzle for powder coating comprising:

A cylindrical hollow nozzle having an annular front edge and a rear end portion to be connected to a powder paint supply tube;

A paint guide member provided with a front end portion having a peripheral side face of conical or concaved conical shape whose radius gradually increases toward its front end, and positioned within said hollow nozzle coaxially with the nozzle and spaced apart from the inner wall of the nozzle to extend said front end portion forwardly from the front edge of the nozzle;

An adjusting compressed air passage formed in said paint guide member coaxially with the member through the central portion of the member, and having an rear end portion to be connected to a adjusting compressed air supply tube which extends inside of said powder paint supply tube coaxially therewith;

A conical cavity formed coaxially within the front end portion of said paint guide member, and having a front end opening over almost the whole area of the front end face of the member and a rear end portion communicating with said adjusting compressed air passage;

A pattern adjusting member of conical or truncated conical shape provided with a front end portion having a conical peripheral side surface of about the same vertical angle with that of said conical cavity, and coaxially positioned in said conical cavity to form, between the conical peripheral side surface of its front end portion and the inner wall of the front end portion of the conical cavity, an annular adjusting compressed air discharge slit of conical shell shape communicating with said adjusting compressed air passage; and an air chamber formed in the front end portion of said pattern adjusting member to open its front end over about whole area of the front end face of the pattern adjusting member and communicating with said adjusting compressed air passage, and an air venting thin plate made of a porous material and closing the front end opening of said air chamber.

A projecting nozzle for powder coating capable of adjusting projection pattern of powder paint projected through an annular slit between a hollow nozzle and a paint guide member positioned in the nozzle, characterized in that said projecting nozzle comprises;

A cylindrical hollow nozzle having an annular front edge and a rear end portion to be connected to a powder paint supply tube;

A paint guide member provided with a front end portion having a peripheral side face of conical or concaved conical shape whose radius gradually decreases toward its front end, and positioned within said hollow nozzle coaxially with the nozzle and spaced apart from the inner wall of the nozzle to extend said front end portion forwardly from the front edge of the nozzle;

An adjusting compressed air passage formed in said paint guide member coaxially with the member through the central portion of the member, and having a rear end portion to be connected to an adjusting compressed air supply tube which extends inside of said powder paint supply tube coaxially therewith;

A cavity formed coaxially in the front end portion of said paint guide member to have a circular cross section, and a front end opening in the front end face of the member and a rear end portion communicating with said adjusting compressed air passage; and A pattern adjusting member having a cylindrical air swirling chamber defined by a cylindrical peripheral side wall and a rear end wall to have an open front end and a plurality of compressed air inlet apertures formed at about equal spacing through the rear end portion of said peripheral side wall in the direction tangential to the inner surface of the wall to communicate said air swirling chamber to said adjusting compressed air passage, and fitted coaxially and air tightly within the front end portion of said cavity so that the front face of the pattern adjusting member lies in the plane of the front face of said paint guide member.

Hereunder, a projecting nozzle for powder coating disclosed in the present invention is explained on the basis of its embodiments referring to the drawings attached.

DETAILED DESCRIPTION

Figure 1:
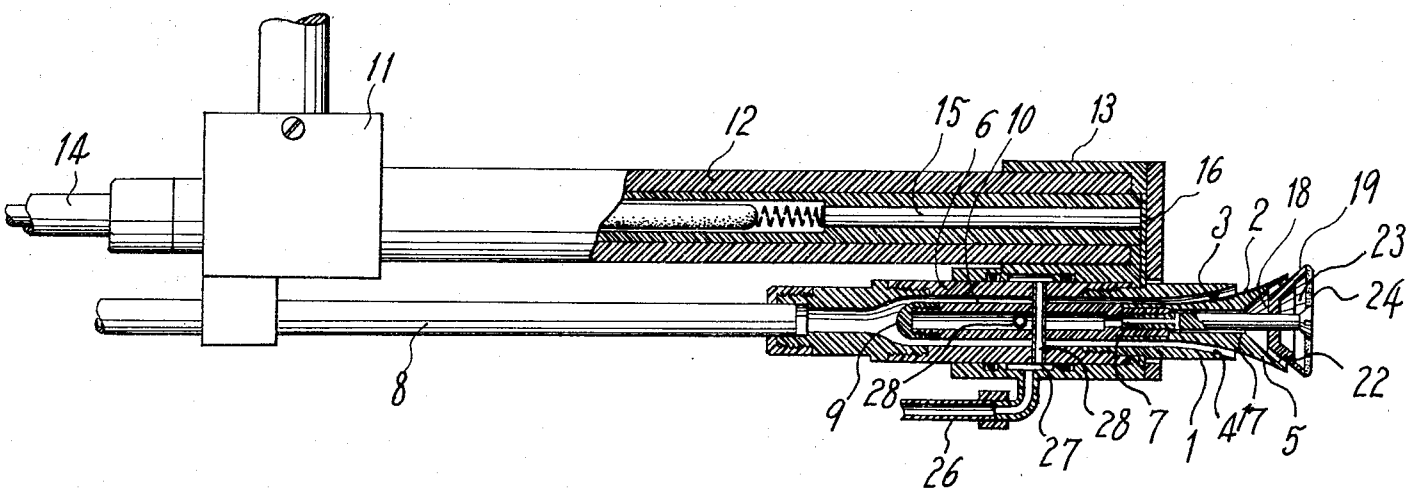
FIG. 1 attached to the specification shows a part of the transverse side sectional view illustrating the electrostatic powder coating apparatus equipped with the projection nozzle of the present invention.
Figure 2:
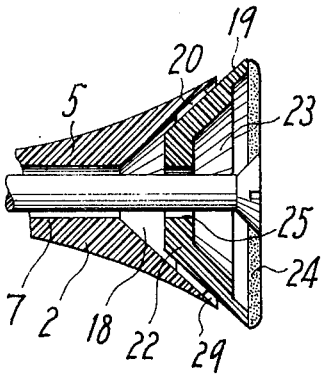
FIGS. 2 and 3 are the transverse side sectional view and the rear end view showing in detail the pattern adjusting member of the projection nozzle shown in FIG. 1.

FIG. 1 illustrates an electrostatic powder coating apparatus equipped with the projection nozzle disclosed in the present invention, and the subject projection nozzle is composed of hollow nozzle 1 of the conical type having a sharp conical edge and peripheral surface 2 whose cross-sectional shape widens toward the front edge as shown in FIG. 2, and paint guiding member 5 extending from the nose of the hollow nozzle to the front, being placed coaxially in the hollow nozzle 1 so as to form an annular gap 4 between peripheral surface 2 and inner wall surface 3 of hollow nozzle 1, and the rear edge of hollow nozzle 1 is connected with paint supply hose 6, and at the rear edge of paint guiding member 5, and a compressed air supply hose 7 is placed coaxially within paint supply hose 6.

Powder paints being supplied into the rear edge portion of paint supply hose 6 through paint supply hose 8 entrained in carrying air by a proper device, for example, such as a floating floor from a proper powder supply source (not illustrated) are to be equally dispersed about the whole periphery of paint guiding member 5 from the front edge of hollow nozzle 1 through a paint discharging path that is formed in annular gap 4 between the inner wall surface of said hollow nozzle 1 and peripheral wall surface of paint guiding member 5, and the powder paints are to be emitted in the form of a mist along peripheral surface 2 thereof.

Hollow nozzle 1 is made of electric insulating materials and to which a high resistance electrically conductive material or electrically conductive film is provided in its outer peripheral surface. For example, as illustrated, the subject hollow nozzle is combined with projection nozzle by a proper support member 11, cable support tube 12 and a proper combining member 13, and the subject hollow nozzle, through insulating high voltage cable 14, high resistance current control resistor 15 and conductive member 16, is to be charged by D.C. high voltage from a proper high voltage electric source (not illustrated). By the high voltage, an electrostatic field is to be generated between hollow nozzle 1 and articles to be coated (not illustrated), and at the sharp annular front edge of hollow nozzle 1, electric line of force of the said electrostatic field is to be concentrated and therefore, highly ionized zones are to be formed adjacent to this front edge. Furthermore, according to the illustrated embodiment and as an alternative to using hollow nozzle 1 as the electrode, electrodes for generation of electrostatic field and those for charging the paint particles are constructed by paint guiding member 5 so as to generate the electrostatic field between paint guiding member 5 and articles to be coated (not illustrated) and thus, at the sharp portion of the front peripheral edge of paint guiding member 5, the highly ionized regions may be formed.

As disclosed in the illustrated examples, when electrodes are to be constructed by hollow nozzle 1, the paint particles emitted from the front edge of hollow nozzle 1 through annular gap 4 between the inner wall surface of the hollow nozzle and the peripheral surface of paint guiding member 5 are effectively charged as they pass through the highly ionized zones formed adjacent to the front edge of hollow nozzle 1, and by the mutual action of the electrostatic field formed between hollow nozzle 1 and the articles to be coated and the charge maintained by the particles, the subject paint particles are to be deposited on the surface of the articles. Further, in the case when the paint particles are to be charged paint guiding member 5, the paint particles emitted from the front edge of hollow nozzle 1 move along peripheral surface 2 of paint guiding member 5, and they pass through the highly ionized regions formed adjacent to the front peripheral edge of paint guiding member 5 and there they are effectively charged, and are deposited on the surface of the articles to be coated by electrostatic actions.

As set forth above, according to the projection nozzle of the present invention, the projection pattern is adjusted by applying the compressed air flow for adjusting the flow of the paint particles from its inside, which paint particles are emitted from annular gap 4 between hollow nozzle 1 and paint guiding member 5 along peripheral surface 2 of the whole peripheral of paint guiding member 5.

Figure 3:
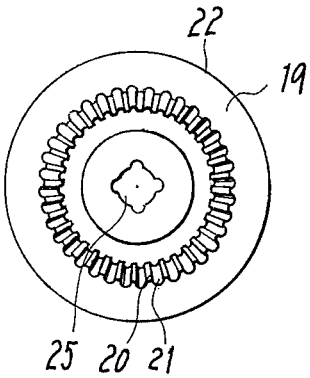

In order to attain this object, in the embodiments shown in FIGS. 1, 2 and 3, the central portion of paint guiding member 5 is provided with an axial bore which forms a compressed air path 17 the rear end edge of which communicates with compressed air supply hose 7, and the inner portion of the edge portion of paint guiding member 5, is provided with a forwardly widening conical cavity 18 the front edge of which namely the diameter of its opening portion, is almost equal to the diameter of the front edge surface of the paint guiding member. In conical cavity 18, a circular truncated cone type pattern adjusting member 22 is placed and fixed coaxially thereto, in said circular truncated cone type pattern adjusting member there is provided a conical annular projecting portion 21 with plural grooves 20 extending almost in parallel with the main line of the circular surface in the portion adjacent to the small diameter edge portion of outer peripheral surface, having the vertical angle almost equivalent to that of the circular type inner wall surface of the cavity, is formed. In the inner portion of the front edge portion of pattern adjusting member 22, air chamber 23 opened to almost all the surface of the front edge surface of the same is provided, and the opening of the front edge of this chamber is to be closed by air-permeable thick plate 24 made of porous materials, and the inside of air chamber 24 is communicated with said compressed air path 17 by air orifice 25 provided by perforating through its rear edge wall.

It follows that air supplied to compressed air path 17 through compressed air supply hose 26 which communicates with a proper compressed air supply source (not illustrated) said hose 26 is mounted on said combining member 13, flows into an annular air hole groove 27 provided in combining member 13, then via a connecting pipe 28 combined with air hole 27 into compressed air pipe 7 from compressed air pipe 7 flows into cavity 18 of the front edge portion of paint guiding member 5 passes each groove 20 of projecting portion 21 provided in the small diameter portion of the pattern adjusting member 22, and through conical annular gap 29 formed between the inner wall surface of conical cavity 18 and conical outer peripheral surface 19 of the front edge portion of pattern adjusting member 22, the subject air is thus discharged equally about the whole periphery of pattern adjusting member 22. As set forth above, the air thus is to be sprayed from the inside of the paint particle flow which flows along with peripheral surface 2 of paint guiding member, being emitted from annular gap 4 between the hollow nozzle 1 and paint guiding member 5. Accordingly, by properly changing the pressure of the compressed air, velocity and flow amount of the same to be supplied into compressed air pipe 7, it would be possible to adjust the pattern of the paint particles in the form of mist being projected from the projection nozzle covering widely the area.

Furthermore, a part of the compressed air supplied into conical-type cavity from compressed air path 17 gets into air chamber 23 through air hole 25, and through fine orifices of air permeable thick plate 24, it is emitted covering the whole surface thereof, thereby deposition of the paint particles on the front edge surface of pattern adjusting member 22 can be prevented and therefore, effectively prevent that deterioration of the quality of coating resulting from the sporadic peeling off of the particles that would normally adhere to the front surface of adjusting member 22.

Figure 4:
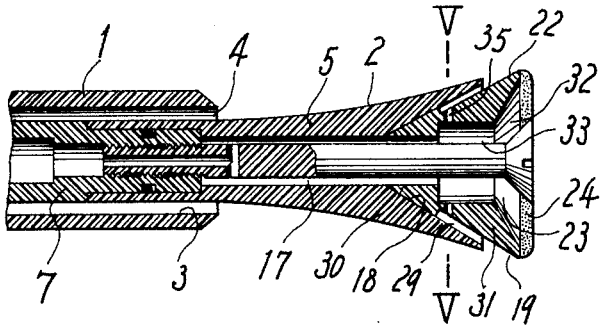
FIG. 4 is the transverse side view showing the other embodiments of the projection nozzle of the present invention.
Figure 5:
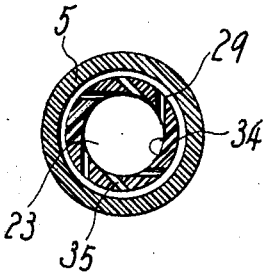
FIG. 5 is the sectional view along with V — V line of FIG. 4.

FIGS. 4 and 5 respectively show the other embodiments of the pattern adjusting member suitable for using the projection nozzle of the present invention.

The subject pattern adjusting member 22 is composed of: rear edge portion 30 having conical peripheral surface which meets with the inner wall surface of conical cavity 18 of paint guiding member 5; front edge portion 31 having conical outer peripheral surface 19 formed so as to form conical annular gap 29 being the same as shown in FIGS. 1 and 2. Air chamber 23 having conical front portion 32 opened to almost all the surface of the front edge surface of the pattern adjusting member and conical rear portion 33 is formed in front edge portion 31. The front opening of air chamber is closed by air-permeable thick plate 24 made of porous materials, and the front opening of air chamber is communicated with compressed air path 17 by air hole 25 provided by perforating through rear edge portion 30. At peripheral wall 34 of the conical rear portion 33 of air chamber 23, plural openings 35 having its axial in inner surface are spaced at equal intervals.

In pattern adjusting member 22, the compressed air being fed into air chamber 23 from compressed air path 17 flow out through conical annular gap 29 that is formed between the inner wall surface of conical cavity 18 of paint guiding member and conical outer peripheral surface 19 of front edge portion 31 of pattern adjusting member 22 through each hole 35, and thereafter the compressed air begins to rotate in this gap and is to be discharged in a tangential direction from the front opening of gap 4 covering the whole periphery, and the compressed air is to be sprayed from its inside by paint particle flour projected along peripheral surface 2 of paint guiding member from annular gap 4 between hollow nozzle 1 and paint guiding member 5 so as to adjust the projection pattern. A part of the compressed air in air-chamber 23 is discharged through each fine orifice of air-permeable thick plate 24 covering the whole surface thereof, thereby the deposition of paint particles on the front edge surface of pattern adjusting member 22 can be prevented.

Figure 6:
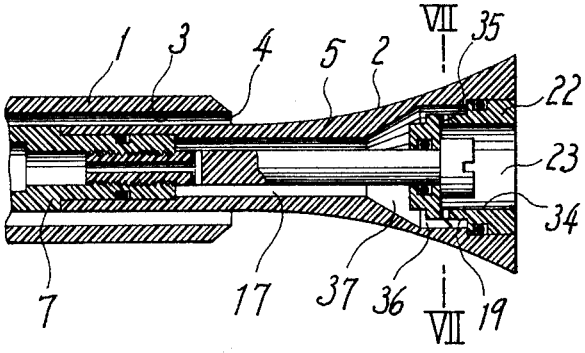
FIG. 6 is the transverse side view showing the other embodiments of the projection nozzle of the present invention.
Figure 7:
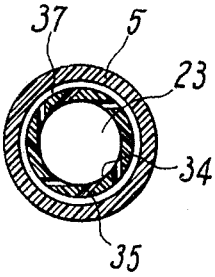
FIG. 7 is the sectional view along with VII — VII line of FIG. 6.

FIGS. 6 and 7 show other embodiments of the pattern adjusting member suitable for the projection nozzle of the present invention. In a case when pattern adjusting member 22 is to be used, hollow portion 37 having conical front edge portion 36 opened to the front edge surface of pattern adjusting member 22 having one-third diameter of the front edge surface thereof is provided coaxially, and this hollow portion is communicated with compressed air path 17. In pattern adjusting member 22, conical air chamber 23 having a comparatively large diameter opens forwardly to the inside of conical outer surface 19 as illustrated, and at peripheral side wall 34 of air chamber 23, plural orifices 35 having a direction tangential in its inner wall surface are placed at equal intervals. Pattern adjusting member 22 having the construction set forth above is fitted coaxially in hollow portion 37 so as to position the front edge surface of the paint guiding member 5 and the front edge surface of the pattern adjusting member in the same plane, and the front edge opening of hollow portion 37 is to be closed tightly by the pattern adjusting member, thereby the inner portion of hollow portion 37 and the inner portion of air chamber 23 are communicated with each other through each orifice 35. It follows therefore that the compressed air being fed to hollow portion 37 from compressed air path 17 is led into air chamber 23 through each orifice 35, and the compressed air reaches the front edge opening of the air chamber as a swirling mass, and by centrifugal force on the basis of the turning movement, the compressed air is equally discharged toward the whole front peripheral edge of the paint guiding member along with the front edge surface of pattern adjusting member 22 positioned in the same plane and the front edge surface of paint guiding member 5, and further the compressed air is blown off from its inside by the paint particle flour injected along peripheral surface 2 of the paint guiding member from annular gap 4 between hollow nozzle 1 and paint guiding member 5, thereby the adjustment of pattern can effectively be done. Furthermore, in pattern adjusting member 22, the compressed air for use in pattern adjustment flows along each front edge surface of pattern adjusting member 22 and paint guiding member 5 and therefore, it is not necessary to provide the air-permeable thick plate at the front edge of pattern adjusting member 22 as disclosed in the embodiment shown in FIGS. 1, 2, 3, 4 and 5.

According to the embodiment shown in FIG. 6, pattern adjusting member 22 and paint guiding member 5 have their respective front end surfaces almost perpendicularly to their longitudinal axis, but if desired, it may provide the annular conical front edge widening forwardly with comparatively large vertical angle.

As clearly understood from the explanations set forth above, according to the projection nozzle for powder coating of the present invention, the pattern of the paint particles being projected can effectively and surely be adjusted covering a wide scope of area by a simple operation that controls and change the pressure, velocity and amount of the compressed air for adjustment, thereby a remarkable useful effect can be attained.

What we claim is:

1. A projecting nozzle for powder coating capable of adjusting the projection pattern of powder paint projected through a slit between a hollow nozzle and a paint guide member positioned within the nozzle, characterized in that said projecting nozzle comprises:

A hollow nozzle having an open front end and a rear end portion to be connected to a powder paint supply tube;

A paint guide member provided with a front end portion having a peripheral side face whose dimensions gradually increase toward its front end, and positioned within said hollow nozzle and spaced apart from the inner wall of the nozzle to extend said front end portion forwardly beyond the front end of the nozzle;

An adjusting compressed air passage formed within said paint guide member through the central portion of the member, and having a rear end portion to be connected to an adjusting compressed air supply tube;

A cavity formed within the front end portion of said paint guide member, and having a front end opening in the front end face of the member and a rear end portion communicating with said adjusting compressed air passage;

A pattern adjusting member provided with a front end portion having a peripheral side surface of about the same configuration as that of said cavity, and positioned within said cavity to form, between the peripheral side surface of its front end portion and the inner wall of the front end portion of the cavity, an adjusting compressed air discharge slit of increasing size communicating with said adjusting compressed air passage; and An air chamber formed in the front end portion of said pattern adjusting member to open its front end over most of the area of the front end face of the pattern adjusting member and communicating with said adjusting compressed air passage, and an air venting member partially closing the front end opening of said air chamber.

2. A projecting nozzle for powder coating as set forth in claim 1 with the addition that the peripheral side face of the paint guide member is of conical shape.

3. A projecting nozzle for powder coating as set forth in claim 1 with the addition that the peripheral side face of the paint guide member is of concaved shape.

4. A projecting nozzle for powder coating as set forth in claim 1, wherein the paint guide member is positioned coaxially within the hollow nozzle.

5. A projecting nozzle for powder coating as set forth in claim 1, wherein the cavity within the front end portion of the paint guide member is a conical cavity which lies coaxially within said chamber.

6. A projecting nozzle for powder coating as set forth in claim 1, wherein the pattern adjusting member is of conical shape.

7. A projecting nozzle for powder coating as set forth in claim 1 wherein the air venting member is in the form of a thin plate of porous material.

8. A projecting nozzle for powder coating capable of adjusting the projection pattern of powder paint projected through a slit between a hollow nozzle and a paint guide member positioned within the nozzle, characterized in that said projecting nozzle comprises:

A hollow nozzle having an open front end and a rear end portion to be connected to a powder paint supply tube;

A paint guide member provided with a front end portion having a peripheral side face of generally conical shape whose radius gradually increases toward its front end, and positioned within said hollow nozzle generally coaxially with the nozzle and spaced apart from the inner wall of the nozzle to extend said front end portion forwardly beyond the front end of the nozzle;

An adjusting compressed air passage formed within said paint guide member through the central portion of the member, and having a rear end portion to be connected to an adjusting compressed air supply tube;

A cavity formed within the front end portion of said paint guide member having a front end opening in the front end face of the member and a rear end portion communicating with said adjusting compressed air passage; and A pattern adjusting member having an air swirling chamber defined by a peripheral side wall and a rear end wall to have an open front end and a plurality of compressed air inlet apertures spaced along the rear end portion of said peripheral side wall in a direction generally tangential to the inner surface of the wall to communicate said air swirling chamber to said adjusting compressed air passage, and fitted air tightly within the front end portion of said cavity so that the front face of the pattern adjusting member lies generally in the plane of the front face of said paint guide member.

9. A projecting nozzle for powder coating as claimed in claim 8 wherein the swirling chamber is cylindrical and the plurality of compressed air inlet apertures are spaced at equal distances along the peripheral side wall.

10. A projecting nozzle for powder coating as claimed in claim 8 wherein there are eight compressed air inlet apertures.

* * * * *

UNITED STATES PATENT OFFICE

CERTIFICATE OF CORRECTION

Patent No. 3,977,607 Dated August 31, 1976

Inventor(s) Kunio Kobayashi et al

It is certified that error appears in the above-identified patent and that said Letters Patent are hereby corrected as shown below:

Column 8, line 11, "chamber" should read --- member ---.

Signed and Sealed this

Fourth Day of January 1977

[SEAL]

*Attest:*

RUTH C. MASON
*Attesting Officer*

C. MARSHALL DANN
*Commissioner of Patents and Trademarks*